United States Patent [19]

LaPorta, Jr.

[11] Patent Number: 4,547,905

[45] Date of Patent: Oct. 22, 1985

[54] ATHLETIC SHOULDER PAD

[76] Inventor: Phil LaPorta, Jr., 1111 N. Glenstone, Springfield, Mo. 65802

[21] Appl. No.: 593,543

[22] Filed: Mar. 26, 1984

[51] Int. Cl.[4] ..... A41D 13/00

[52] U.S. Cl. ..... 2/2; 2/268

[58] Field of Search ..... 2/2, 45, 268

[56] References Cited

U.S. PATENT DOCUMENTS

| | | | |
|---|---|---|---|
| 1,094,865 | 4/1914 | Pierce | 2/2 |
| 1,709,184 | 4/1929 | Mullins | 2/2 |
| 2,071,827 | 2/1937 | Glahe | 2/2 |
| 2,540,952 | 2/1951 | Kennedy | 2/2 |
| 3,127,614 | 4/1964 | Bennett | 2/2 |

*Primary Examiner*—Werner H. Schroeder
*Assistant Examiner*—J. L. Kravitz
*Attorney, Agent, or Firm*—Kokjer, Kircher, Bradley, Wharton, Bowman & Johnson

[57] ABSTRACT

A shoulder pad construction in which outer plastic shells are held off of the shoulders by rigid underlying arches so that the pad is supported entirely on the chest and back rather than on the shoulders. The opposite ends of the arches are secured to the breast plates and back plates of the shells. Padding for the shells has thick front and back portions which contact the chest and upper back. Bridge portions of the padding are much thinner to avoid impacting the acromio-clavicular joints and are cut back away from the trapezius muscles at the base of the neck to avoid applying pressure to the brachial plexus. Forces applied to the shoulder pad are partially absorbed by the shells and are transmitted to the thick padding areas and to the chest and back without applying pressure to the shoulder or to the acromio-clavicular joints or trapezius muscles.

12 Claims, 3 Drawing Figures

Fig. 1.
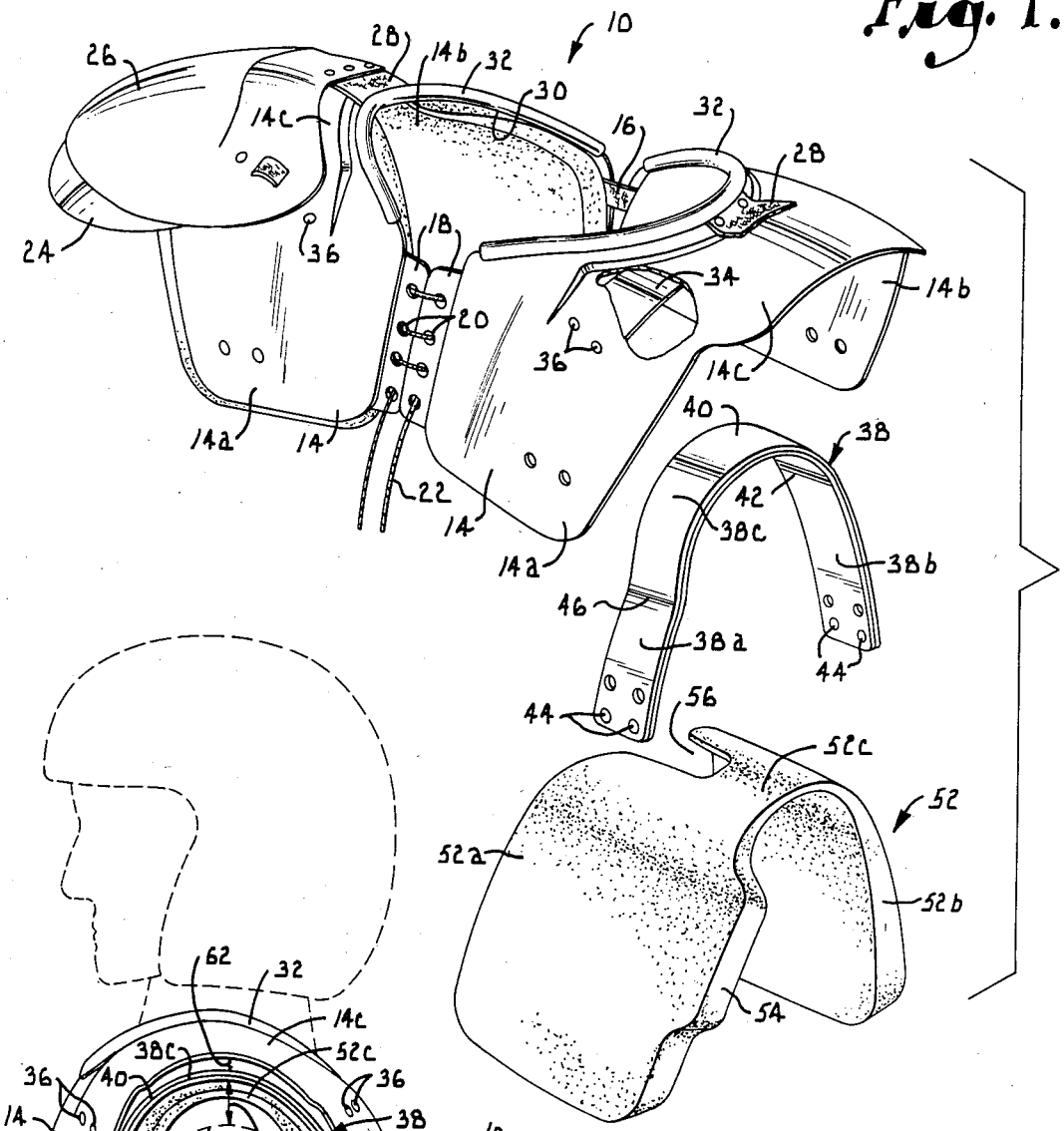
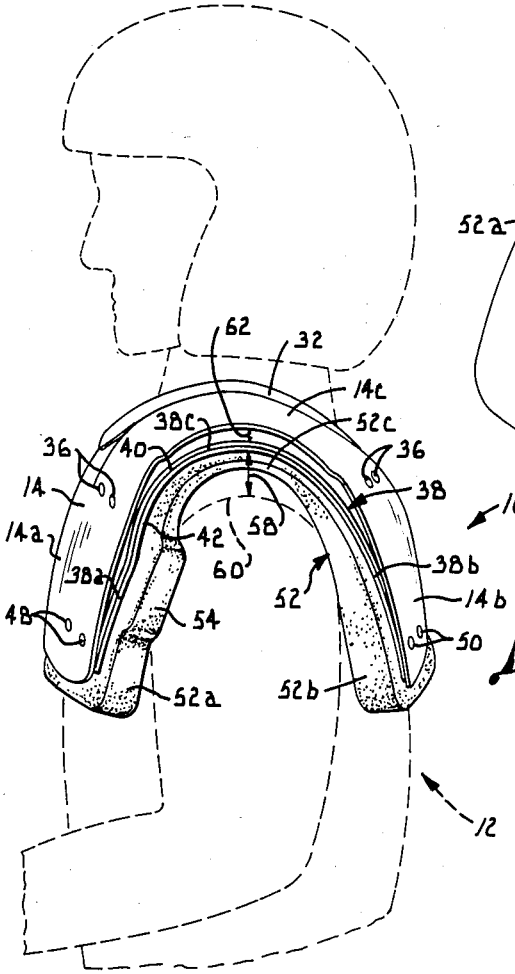
Fig. 2.
Fig. 3.
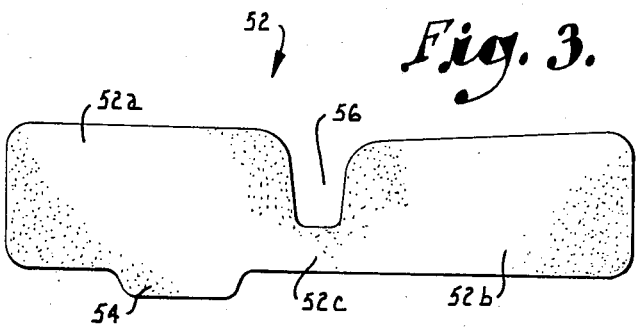

ATHLETIC SHOULDER PAD

BACKGROUND OF THE INVENTION

This invention relates generally to protective athletic equipment and deals more particularly with an improved shoulder pad construction.

The shoulder pad is recognized as being one of the most important protective devices used by football players because of its function in the protection of the shoulder area which is often subjected to significant forces during the course of blocking, tackling and other activities common to the game. Although shoulder pads have become increasingly more sophisticated and expensive over the years, all of the pads that are currently available are constructed in basically the same manner. The shoulder pads take the form of a harness having opposite halves that are applied to the left and right shoulders of the wearer. The body of each half is formed by an arched shell constructed of lightweight molded plastic, typically high density polyethylene reinforced by a steel band. A braided cord strap is secured to the shell in the area which overlies the acromio-clavicular joint (a/c joint). Heavy thick padding is provided beneath the shells and rests directly on the shoulder of the wearer to support the shoulder pads on the shoulders. The padding ordinarily has a leather roll which rests on the trapezius muscle at the base of the neck.

The manner in which existing shoulder pads are constructed is flawed in at least two important respects, and there shortcomings have contributed to serious injuries to football players. First of all, the delivery of a blow to the shoulder pad results in compression of the plastic shell and transmission of the force through the shell to the braided cord strap and the underlying padding. Although the shell and padding compress and partially absorb the force, the fact that the padding rests directly on the shoulder invariably results in at least some of the force being transmitted through the padding to the shoulder area in general and to the a/c joint and trapezius muscle in particular. When the impact force is severe, the shoulder pad is unable to absorb enough of the force to prevent it from being transmitted in significant part to the relatively weak a/c joint, often seriously injuring it and the shoulder area in general.

The second major problem is caused by the padding resting directly on the trapezius muscle at the base of the neck in the vicinity of the brachial plexus. A powerful blow applied to the shoulder pads is transmitted through the plastic shell and padding and imparts considerable pressure on the trapezius muscle and adjacent nerves. This can cause injuries of the type commonly known as "pinched nerves" and can result in other serious damage to the brachial plexus.

SUMMARY OF THE INVENTION

I have developed an improved shoulder pad construction which departs from the concepts currently used to construct shoulder pads and which is aimed specifically at eliminating or at least minimizing the types of injuries previously discussed. In accordance with my invention, I provide arch shaped plastic shells which rest on the chest and back areas rather than on the shoulder as occurs with other pads. The arch or bridge areas of the shells extend over the shoulder well above it by several inches. The support system includes a rigid arch beneath each shell which is riveted or otherwise secured at its opposite ends to the breast and back plates of the shell. The arches curve over the a/c joints and are spaced about 1½–2 inches above them. The rigidity of the arches prevents them from yielding and holds the shells off of the a/c joints in order to prevent them from being impacted when the shoulder pad is subjected to heavy blows.

I also use padding having a unique configuration to cooperate effectively with the other components of the shoulder pad. The padding is relatively thick (1–3 inches) in the chest and back area to provide cushioning of the chest and back where the forces are applied. The thickness of the padding in the chest and back areas also helps to lift and maintain the shells and arches off of the shoulders. The padding has thin bridge portions (about ⅛ inch thick) which extend over the a/c joints and which are cut back well away from the trapezius muscle at the base of the neck. The overall result is that blows delivered to the shoulder pad are partially absorbed by the outer shells and padding. The outer shell compresses. However, the rigidity of the arches prevents them from compressing and they hold the outer shell and the arches well off of the shoulder to prevent impact to the a/c joints and the shoulder in general. The forces which are not absorbed by the outer shell are transmitted to the breast and back plates and to the thick parts of the padding and then to the chest and back areas which are stronger than the shoulder area. The lack of padding on the trapezius muscle prevents the forces from being transmitted to the brachial plexus and adjacent areas at the base of the neck.

DETAILED DESCRIPTION OF THE INVENTION

In the accompany drawing which forms a part of the specification and is to be read in conjunction therewith and in which like reference numerals are used to indicate like parts in the various views:

FIG. 1 is an exploded perspective view of a shoulder pad constructed according to a preferred embodiment of the present invention, with a portion broken away for purposes of illustration;

FIG. 2 is a side elevational view showing the shoulder pad applied to a football player depicted in broken lines; and FIG. 3 is a plan view of the padding for one of the shells arranged in flat form.

Referring now to the drawing in more detail, a shoulder pad constructed in accordance with the present invention is generally designated by reference numeral 10. The shoulder pad 10 has two halves which are mirror images of one another for application to the left and right shoulders of a football player 12 (FIG. 2). The opposite halves of the shoulder pad have bodies formed by arch shaped shells 14, each of which has the general shape of an inverted U. Each shell is relatively thin and is constructed of a suitable lightweight molded plastic material such as high density polyethylene having good impact resistance properties. The two shells 14 are connected at the back by one or more elastic straps 16. At the front, each shell has a projecting strip 18 formed of plastic or another material. The two strips 18 are each provided with a series of eyelets 20 through which a lace 22 is threaded. The lace may be pulled tight and tied to secure the shoulder pad 10 in place on the shoulders of the wearer. Underarm straps (not shown) are also provided.

As shown in FIG. 1 for the right half of the shoulder pad, each shell is provided with a padded shoulder cap 24 and an overlying epaulet 26 which is connected with the top of the shell by a flexible strap 28. The two shells 14 have curved inside edged which cooperate to form a neck opening 30 and which receive leather rolls 32 for protection of the neck. A steel band 34 reinforces each shell 14 and is secured thereto by rivets 36. The steel bands 34 extend along the curved undersides of the shells.

Each shell 14 has a breast plate 14*a* which covers the chest of the wearer and a back plate 14*b* which covers the upper back area of the wearer. Extending between the breast plate 14*a* and the back plate 14*b* is an arch shaped bridge portion 14*c* of the shell which curves over the shoulder of the wearer. The reinforcing band 34 is located in the area of the curved bridge portion 14*c* of the shell. Each shell is formed in a single integral piece.

Underlying each shell 14 is a rigid arch 38 formed by substantially identical outside and inside arch members 40 and 42 secured directly against one another as by means of rivets 44 connecting the opposite ends of the arch members. The use of the two arch members 40 and 42 adds to the strength and rigidity of each arch 38. The arch members 40 and 42 may be constructed of any suitable material exhibiting the necessary rigidity.

Each arch 38 has a front end portion 38*a*, and back end portion 38*b* and a central arch portion 38*c* which curves between the end portion 38*a* and 38*b*. The front end portion 38*a* may be bent forwardly somewhat about line 46 in order to better conform with the shape of the body. Rivets 48 and 50 secure the arches 38 to shells 14. The front rivets 48 extend through aligned openings in each breast plate 14*a* and the front end portion 38*a* of each arch 38. The back rivets 50 extend through aligned openings in each back plate 14*b* and the back end portion 38*b* of each arch.

Numeral 52 generally designates a cushion or pad which is preferably formed by a relatively soft material such as a closed cell elastomeric vinyl foam in a stretch fabric cover. Each shell 14 has one pad, and each pad 52 underlies and is secured to its shell. Each pad 52 has a relatively thick front portion 52*a* having a thickness of between one and three inches. A back portion 52*b* of each pad has the same thickness as the front portion 52*a*. The front portion 52*a* is located adjacent to the breast plate 14*a*, while the back portion 52*b* is located adjacent to the back plate 14*b* of the shell, as best shown in FIG. 2. A tab 54 projects outwardly from the front portion 52*a* of each pad.

The front and back portions 52*a* and 52*b* of each pad are connected by a relatively thin bridge portion 52*c* having a thickness of approximately $\frac{1}{8}$ inch which is much thinner than the 1–3 inch thick front and back portions of the pad. The bridge portion 52*c* is also considerably narrower than the front and back portions of the pad which have approximately the same lateral dimensions as the breast plate 14*a* and back plate 14*b*. The bridge portion 52*c* is approximately $1\frac{1}{2}$ inch wide and is located directly above the acromio-clavicular joint and is located well above the shoulder, as will be explained more fully. A cut out 56 is formed in the bridge portion 52*c* in order to locate the bridge portion well outwardly from the neck opening 30 and well away from the trapezius muscle at the base of the neck. This cut out 56 assures that there is no padding located directly on the trapezius muscle. Typically, the padding 52 will be secured to its shell by stitching the lower edges of the front portion 52*a* and back portion 52*b* to the breast plate 14*a* and back plate 14*b*.

In use, the shoulder pad 10 is worn in the manner best shown in FIG. 2 and serves to protect the shoulder area from injury due to forces applied to the shoulder pad. With particular reference to FIG. 2, the relatively thick front portion 52*a* rests on the chest of the wearer, and the equally thick back portion 52*b* rests on the upper back area. The breast plate 14*a* of the shell rests on the front portion 52*a* of the padding, and the back plate 14*b* likewise rests on the back portion 52*a* of the padding. In this manner, the entirety of the shoulder pad 10 is supported on the relatively strong chest and back area of the wearer.

The rigid arches 38 maintain the shoulder pad entirely off the shoulder area of the wearer. The arches curve more gradually than the bridge portions 14*c* of the shells. The gap designated by numeral 58 in FIG. 2 illustrates that the central arch portion 38*c* of arch 38 is located well above the shoulder 60 of the football player 12. Normally, the gap 58 is at least $1\frac{1}{2}$ inches and may be as much as 3 inches. In the normal condition of shell 14, its bridge portion 14*c* is spaced above the arch portion 38*c* to present a gap 62 between the arch and shell in the area immediately above the shoulder. The gap 62 can be $1$–$1\frac{1}{2}$ inches. The bridge portion 52*c* of pad 52 is located directly above the acromio-clavicular joint and immediately below the central arch portion 38*c* of the arch. The relatively stiff nature of the pad 52 maintains bridge portion 52*c* slightly above the shoulder 60.

In this manner, the shoulder pad is entirely supported on the chest and back areas of the wearer and does not contact or rest on the shoulder, the acromio-clavicular joint, or the trapezius muscle at the base of the neck. The rigid arch 38 holds the shells well above the shoulders of the wearer, and the trapezius muscle is free of padding due to the cut outs 56 in the pads and the location of the bridge portions 52*c* of the padding well outwardly of the neck opening 30.

When a blow is delivered to the shoulder pad, such as to the top of shell 14, the shell compresses somewhat and partially absorbs the force of the blow. However, the rigidity of the arch 38 prevents it from compressing significantly, and the arch portion 38*c* is held above and off of the shoulder. The blow is transmitted through the shell 14 and the rigid arch 38 to the breast and back plates 14*a* and 14*b* and then to the thick front and rear portions 52*a* and 52*b* of pad 52. These relatively thick padding portions compress and absorb a portion of the force and transmit the remainder to the relatively strong chest and back area of the athlete. The entire shoulder area is protected since none of the force is applied directly to the shoulder due to the action of the rigid arches 38.

At the same time, there is no pressure applied to the trapezius muscle or the adjacent brachial plexus, and this area is not impacted to cause injuries in the nature of "pinched nerves". In this manner, the shoulder area in general and the acromio-clavicular joint, trapezius muscle and brachial plexus in particular are protected by assuring that all of the force is transmitted to the stronger chest and back areas rather than to the weaker shoulder area.

From the foregoing, it will be seen that this invention is on be well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompany drawing is to be interpreted as illustrative and not in a limiting sense.

Having thus described the invention, I claim:

1. An athletic shoulder pad construction comprising:

a pair of outer shells each including a breast plate for covering the chest of the wearer, a back plate for covering the upper back and a curved bridge extending between said breast and back plates for covering the shoulder, said bridges being spaced above the shoulders and out of contact therewith;

a rigid arch underlying each shell, each arch having opposite end portions rigidly secured to the breast and back plates of the corresponding shell and curving between said opposite end portions to present an arch configuration which extends over the shoulder and which is separated from the shoulder and from the bridge of the corresponding shell by gaps, said arches being sufficiently rigid to hold said bridges of the shells off of and above the shoulders; and a relatively soft pad underlying each arch and shaped to permit the breast and back plates of each shell to rest on the chest and back of the wearer with the rigidity of said arches preventing the bridges from applying forces to the shoulders when forces are applied to said shells, whereby forces applied to the shells are transmitted through said breast and back plates and said pads to the chest and back of the wearer without applying stress to the shoulders.

2. The invention of claim 1, wherein each pad includes:

relatively thick front and back portions adjacent the breast and back plates of the shells, said front and back portions engaging the chest and back of the wearer for cushioning thereof; and a relatively thin bridge portion connecting said front and back portions, said bridge portion being substantially thinner than said front and back portions.

3. The invention of claim 2, wherein the bridge portion of each pad is cut away immediately above the trapezius muscle at the base of the neck of the wearer to avoid impacting the trapezius muscle upon application of forces to the shells.

4. The invention of claim 1, wherein:

said shells have curved inside edges cooperating to form a neck opening for receiving the neck of the wearer;

said inside edges are provided with a neck roll;

each pad has front and back portions interconnected by a bridge portion of the pad; and said bridge portions are spaced outwardly from said neck roll to avoid impacting the trapezius muscle at the base of the neck when forces are applied to said shells.

5. The invention of claim 4, wherein the bridge portion of each pad is cut away above the trapezius muscle.

6. The invention of claim 5, wherein said front and back portions of each pad are substantially thicker than said bridge portion.

7. The invention of claim 4, wherein said front and back portions of each pad are substantially thicker than said bridge portion.

8. In an athletic shoulder pad, the combination of:

a pair of shells for protecting the shoulders of the wearer, each shell having a breast plate for covering the chest of the wearer, a back plate for covering the upper back, and a curved bridge for covering the shoulder a spaced distance above same;

a rigid arch member underlying each shell, each arch member having opposite end portions rigidly secured to the breast and back plates of the corresponding shell and a curved arch portion which is shaped to extend over the shoulder and which is separated from the shoulder and from the bridge of the corresponding shell by gaps, said arch members being sufficiently rigid to hold the bridges off of the shoulder; and a relatively soft pad underlying each arch member, each pad having relatively thick front and back portions adjacent the breast and back plates and a relatively thin bridge portion connecting said front and back portions, said front and back portions of the pads engaging the chest and back and said breast and back plates resting on said front and back portions to support the shoulder pad entirely on the chest and back with said bridges held off of the shoulder by said arch members, whereby forces applied to said shells are transmitted through said breast and back plates and the thick front and back portions of the pads to the chest and back of the wearer without applying stress to the shoulder.

9. The invention of claim 8, wherein:

said shells cooperate to form a neck opening for receiving the neck of the wearer; and said bridge portions of the pads are spaced outwardly of said neck opening to avoid impacting against the trapezius muscle at the base of the neck of the wearer when forces are applied to the shells.

10. The invention of claim 9, wherein said bridge portions of the pads are narrower than said front and back portions are cut away above the trapezius muscle.

11. In an athletic shoulder pad, the combination of:

a pair of shells for protecting the shoulders of the wearer, each shell having a breast plate, a back plate and a curved bridge connecting the breast and back plates and integral therewith, said shells cooperating to form a neck opening for receiving the neck of the wearer;

a rigid arch underlying each shell, each arch having opposite end portions rigidly secured to the breast and back plates of the corresponding shell and being curved between said opposite end portions in a manner to hold each bridge above the shoulder, each arch being separated from the shoulder and from the bridge of the corresponding shell by gaps and said arches being sufficiently rigid to hold said bridges off of the shoulders and out of the contact therewith; and a relatively soft pad underlying each arch, each pad having front and back portions for contacting the chest and back of the wearer with said breast and back plates resting on said front and back portions to support the shoulder pad entirely on the chest and back and each pad having a bridge portion presenting a lesser width dimension than said front and back portions and each bridge portion being spaced outwardly from said neck opening, whereby the area above the trapezius muscle at the base of the neck of the wearer is free of padding to prevent impact on the trapezius muscle when forces are applied to said sides.

12. The invention of claim 11, wherein said front and back portions of each pad are thicker than the said bridge portion of the pad.

* * * * *